US006978701B1

(12) United States Patent
Buchanan

(10) Patent No.: US 6,978,701 B1
(45) Date of Patent: Dec. 27, 2005

(54) WRENCH

(75) Inventor: Nigel Buchanan, Fife (GB)

(73) Assignee: Smart Tools Limited, Fyfe (GB)

( * ) Notice: Subject to any disclaimer, the term of this patent is extended or adjusted under 35 U.S.C. 154(b) by 0 days.

(21) Appl. No.: 09/937,767

(22) PCT Filed: Mar. 29, 2000

(86) PCT No.: PCT/GB00/01204

§ 371 (c)(1),
(2), (4) Date: Feb. 21, 2002

(87) PCT Pub. No.: WO00/58057

PCT Pub. Date: Oct. 5, 2000

(30) Foreign Application Priority Data

Mar. 29, 1999 (GB) ..... 9907059

(51) Int. Cl.[7] ..... B25B 13/28; B25B 13/52
(52) U.S. Cl. ..... 81/98; 81/64; 81/68; 81/90.6; 81/90.7; 81/91.2
(58) Field of Search ..... 81/64, 65.2, 68, 81/90.3, 90.6, 90.7, 91.2, 98

(56) References Cited

U.S. PATENT DOCUMENTS

| | | | | | |
|---|---|---|---|---|---|
| 1,051,562 | A | * | 1/1913 | Crolla et al. | 81/64 |
| 1,177,620 | A | * | 4/1916 | Hardeman | 81/90.5 |
| 1,464,128 | A | | 8/1923 | Coes | |
| 1,569,148 | A | * | 1/1926 | Stainbrook | 81/64 |
| 1,584,861 | A | * | 5/1926 | Jones | 81/65.2 |
| 1,666,353 | A | | 4/1928 | Schelf | |
| 2,426,498 | A | * | 8/1947 | Franklin | 81/91.2 |
| 2,436,329 | A | | 2/1948 | Stainbrook | |
| 2,457,223 | A | * | 12/1948 | Green | 81/98 |
| D173,568 | S | * | 11/1954 | Green | 81/98 |
| 4,967,612 | A | | 11/1990 | Sparling | |
| 6,431,032 | B1 | * | 8/2002 | Kuryan et al. | 81/64 |

FOREIGN PATENT DOCUMENTS

| | | |
|---|---|---|
| DE | 1 603 767 | 2/1971 |
| DE | 2554427 | 8/1977 |
| GB | 235434 | 6/1925 |

* cited by examiner

*Primary Examiner*—James G. Smith
(74) *Attorney, Agent, or Firm*—Connolly Bove Lodge & Hutz LLP

(57) ABSTRACT

A wrench has a head portion (10) adapted to engage and apply torque to a workpiece, including a ring member (14) which surrounds the workpiece and has a fixed end (16) and a free end (18) such that, when the ring engages a workpiece and a torque is applied in a predetermined direction (48), the ring closes around the workpiece, increasing the grip between the wrench and the workpiece even if the workpiece is substantially worn, damaged or undersized.

20 Claims, 12 Drawing Sheets

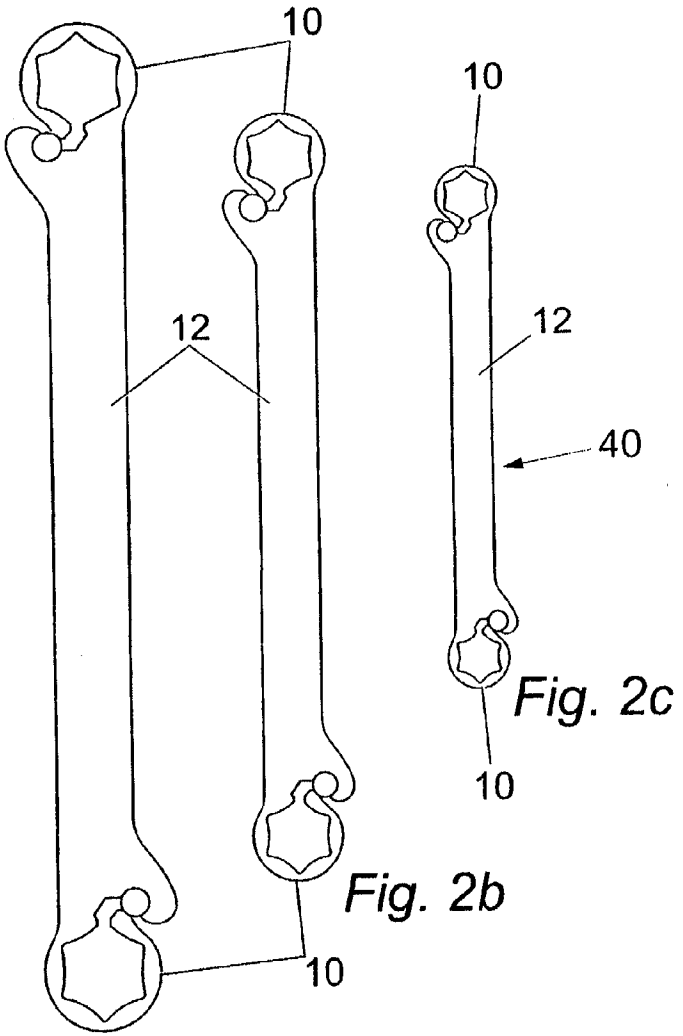
Fig. 2a
Fig. 2b
Fig. 2c
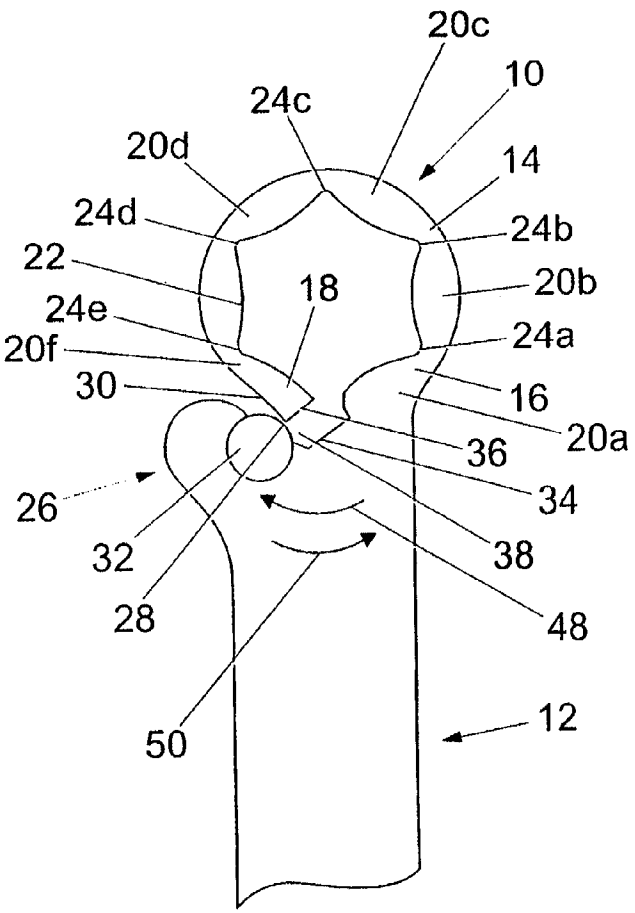
Fig. 1

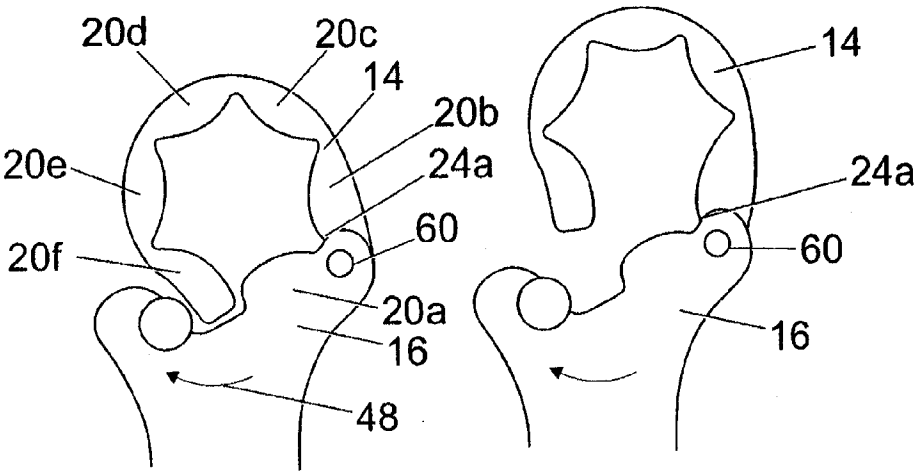
Fig. 6a
Fig. 6b
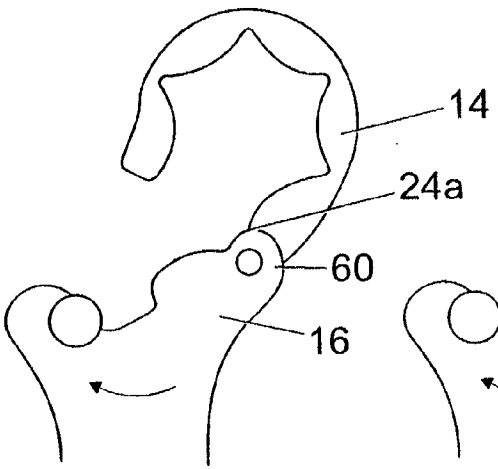
Fig. 6c
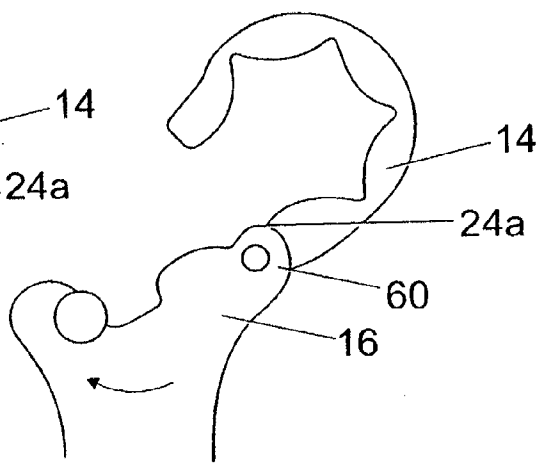
Fig. 6d 76
78
74
79
78

79
76
78
76
78

78
79
76
76
74

WRENCH

The present invention relates to wrenches (also known as "spanners", particularly in the United Kingdom), and in particular to "ring" wrenches.

A wrench is a tool for applying torque to a nut, bolt, screw or the like (hereinafter referred to, for convenience, as a "workpiece") for the purpose of tightening or slackening the workpiece. The wrench has a head portion shaped to engage the periphery of the workpiece in a non-rotatable manner such that a force applied to rotate the head transmits torque to the workpiece. The workpiece generally has a polygonal shape, typically hexagonal or square, and the head of the wrench has a complementary shape and size. The head of a ring wrench is configured to substantially surround the periphery of the workpiece.

The following description will refer particularly to wrenches for use with hexagonal nuts. However, it will be understood that the invention is equally applicable to wrenches and corresponding nuts having other shapes and to other types of workpiece such as bolts and screws.

A conventional ring wrench has a ring-shaped head with a hexagonally shaped inside surface, each section of which is substantially flat. In use, the flat surfaces and corners on the inner surface of the head engage the flat surfaces and corners of the nut to be tightened or slackened. When the head is rotated in the appropriate direction the nut is slackened or tightened as required. However if the nut is undersized, damaged or worn, it is very likely that the head will 'slip' and rotate around the nut instead of properly gripping or engaging the flats and corners of the nut.

It is an object of the present invention to provide an improved wrench with which workpieces that are undersized, damaged or worn can be reliably engaged by the wrench for applying a torque thereto.

In accordance with the invention there is provided a wrench having a head portion adapted to engage and apply torque to a workpiece, said head portion including a flexible ring portion having an inner working surface for engaging the workpiece, such that, when a torque is applied to said head in a predetermined direction, said ring portion closes around said workpiece.

Preferably, said head portion is adapted to engage and apply torque to a workpiece, said head portion including a ring member adapted to substantially surround a peripheral surface of a workpiece and having a first, fixed end and a second, free end such that, when an inner surface of said ring member engages a workpiece and a torque is applied to said head portion in a predetermined direction, said ring member closes around said workpiece.

Preferably, said wrench further includes a first cam surface disposed adjacent an outer surface of a free end portion of said ring such that, when said inner surface of said ring member engages said workpiece and said torque is applied to said head portion in said predetermined direction, said first cam surface presses against said outer surface of said free end portion of said ring.

Preferably also, said first cam surface is generally convex.

Preferably also, said outer surface of said free end portion is generally concave.

Optionally, said first cam surface is formed integrally with said wrench or said first cam surface is provided by an insert.

Preferably, said ring member comprises a plurality of segments.

Preferably also, said segments define a generally polygonal inner surface of said ring member.

Preferably also, each of said segments has an inner surface which is generally convex in the circumferential direction of said ring member.

Preferably, at least some of said segments are formed integrally with one another and said ring member is adapted to deform resiliently at junctions between adjacent, integrally formed segments.

Preferably also, said junctions between adjacent, integrally formed rings have a reduced thickness in the radial direction as compared with the remainder of said segments.

Preferably also, said junctions comprise portions of the inner surface of said ring member which are generally concave in the circumferential direction of said ring member.

Optionally, the inner surface of said ring member is corrugated.

Preferably, said head portion includes means for limiting movement of said free end of said ring member relative to said fixed end thereof in said predetermined direction.

Preferably, said head portion includes means for limiting movement of said free end of said ring member relative to said fixed end thereof in a direction opposite to said predetermined direction.

Preferably, said head portion includes hinge means whereby at least a portion of said ring member may be pivoted in the plane of said ring member relative to the remainder of said head portion.

Preferably also, said ring member comprises a plurality of segments and said hinge means is located between at least one pair of adjacent segments.

Preferably also, the wrench includes resilient bias means associated with said hinge means and adapted to bias said ring member towards a closed position.

In an alternative embodiment, ring portion is pivotably connected to a yoke portion of said head and comprises a plurality of segments interconnected by an elongate flexible member having first and second free ends secured to said yoke portion such that pivoting movement of said ring relative to said yoke in a predetermined direction causes a length of said elongate flexible member passing around said ring to be shortened and the ring to close.

Preferably, first and second segments of said ring are formed integrally with one another as part of a pivot member pivotably mounted in said yoke by means of a pivot pin and the remainder of said segments are formed as discrete members, said flexible elongate member being threaded through said remainder of said segments and the free ends thereof passing around an outer surface of said pivot member and around said pivot pin.

Preferably also, the first free end of the flexible elongate member extends from one of said discrete segments, passes around one part of said outer surface of said pivot member opposite an inner surface thereof defining a first segment, over the top of, around and under the pivot pin, and out of the front of the yoke portion, and wherein the second free end of the of the elongate flexible member extends from another of said discrete segments, passes around a second part of said outer surface of the pivot member opposite an inner surface thereof defining a second segment, under the first free end and the pivot pin, and out of the front of the yoke portion.

Embodiments of the invention will now be described, by way of example only, with reference to the accompanying drawings in which:

FIG. 1 is a front elevation of a head portion of a first embodiment of a wrench in accordance with the present invention;

FIGS. 2*a*, 2*b* and 2*c* are front elevations of examples of dual-head wrenches of different sizes in accordance with the embodiment of FIG. 1;

FIG. 3*a* illustrates in perspective the wrench of FIG. 1 gripping a worn nut and FIG. 3*b* shows a perspective view of the worn nut of FIG. 3*a;*

FIG. 4*a* is a front elevation of a head portion of a second embodiment of a wrench in accordance with the present invention, and FIG. 4*b* is an end elevation the wrench of FIG. 4*a;*

FIG. 5 is a front elevation of a head portion of a third embodiment of a wrench in accordance with the present invention;

FIGS. 6*a*–6*d* are front elevations of a head portion of a fourth embodiment of a wrench in accordance with the present invention in which head is hinged, FIG. 6*a* showing the head in its working position and FIGS. 6*b*, 6*c* and 6*d* showing the head rotated by different angles about the hinge;

Figure 10A:
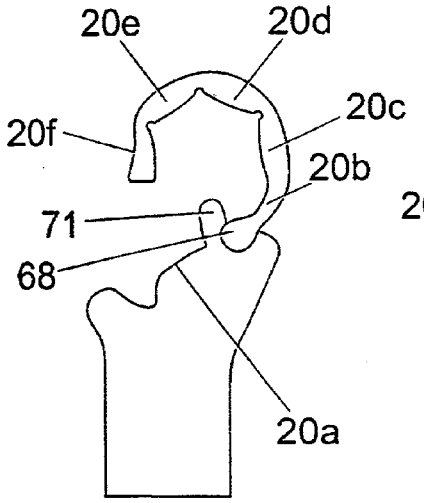
Figure 10B:
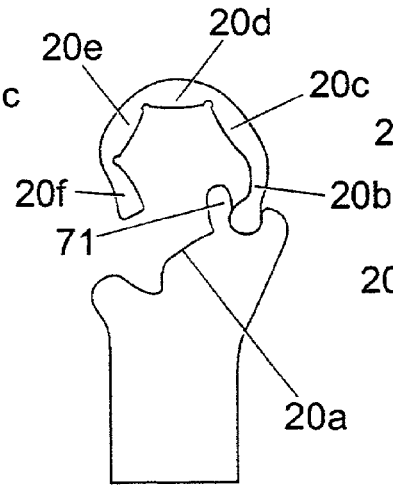
Figure 10C:
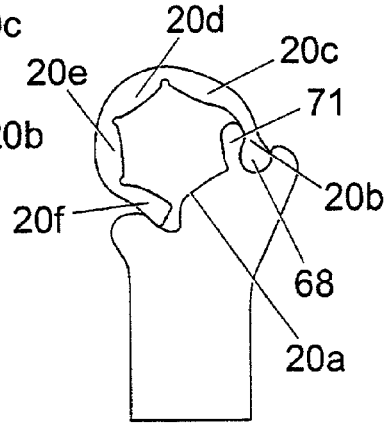
Figure 11C:
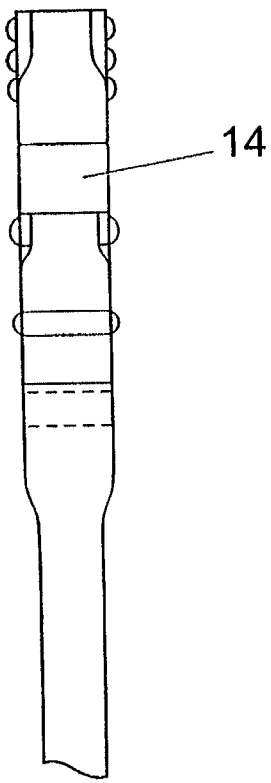
Figure 11B:
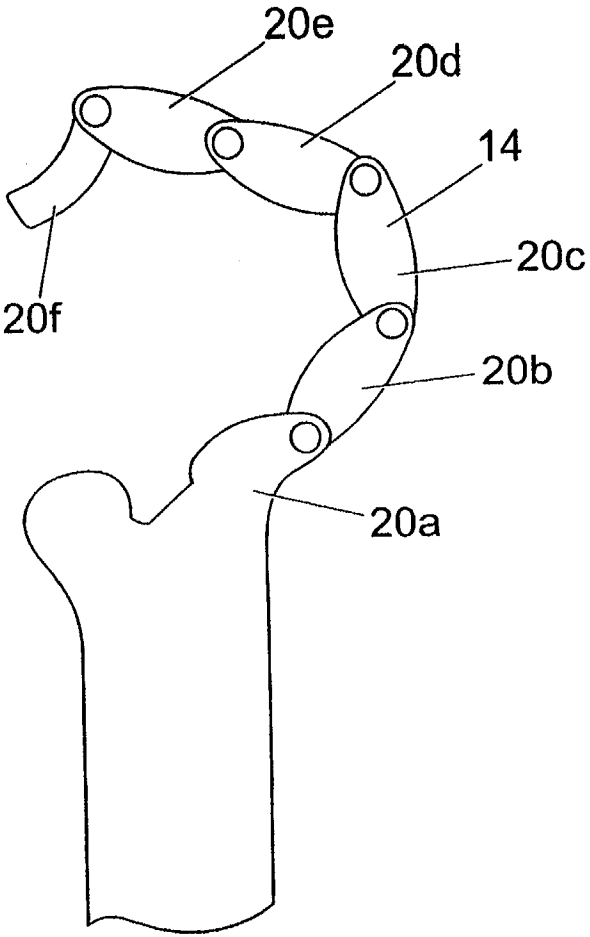
Figure 11A:
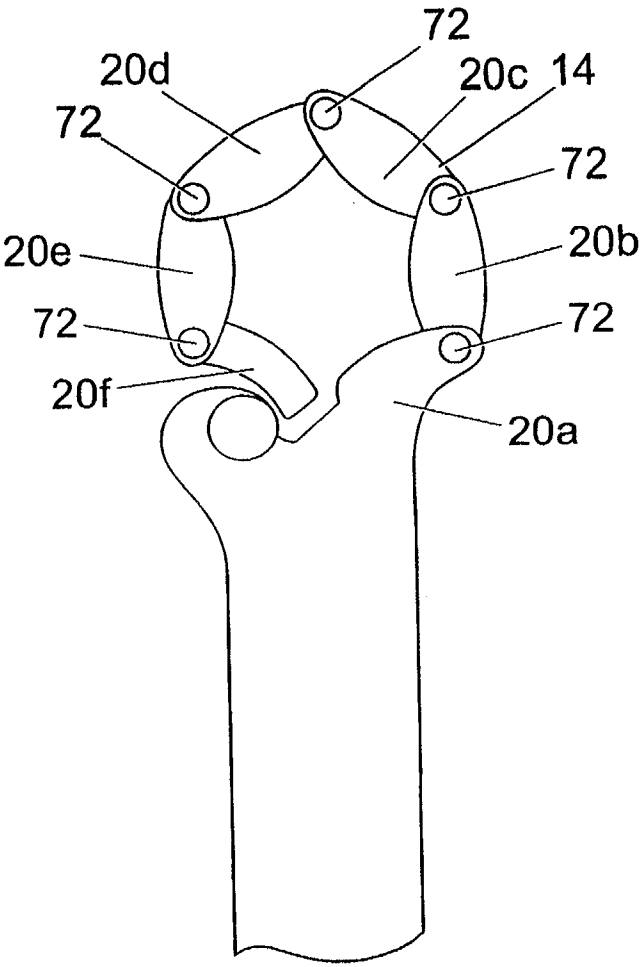

FIGS. 10*a*–10*c* are front elevations of the head portion of an eighth embodiment of a wrench in accordance with the present invention, in which the head is hinged, FIG. 10*c* showing the head in its working position and FIGS. 10*a* and 10*b* showing the head in fully and partially open positions;

FIGS. 11*a* and 11*b* are front elevations of the head portion of a ninth embodiment of a wrench in accordance with the present invention in which the head includes multiple hinges, FIG. 11*a* showing the head in its working position and FIG. 11*b* showing the head in an open position, and FIG. 11*c* is a side elevation the wrench of FIG. 11*a;*

Figure 12A:
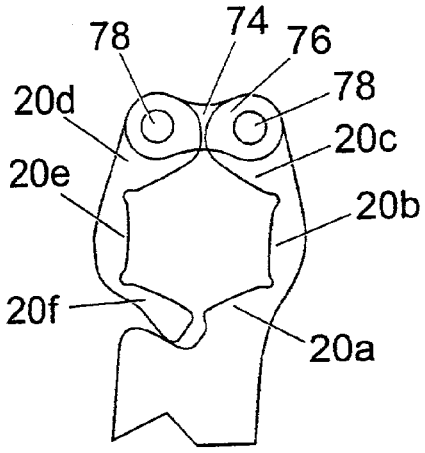
Figure 12B:
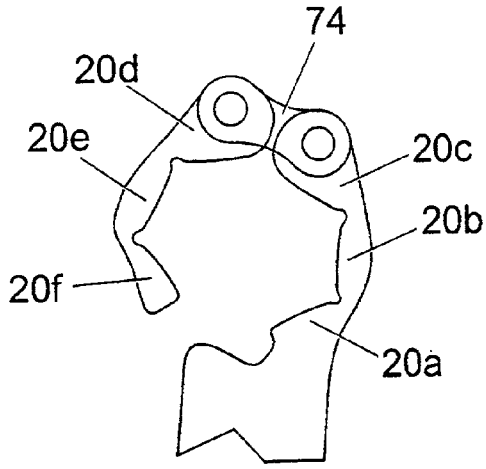
Figure 12C:
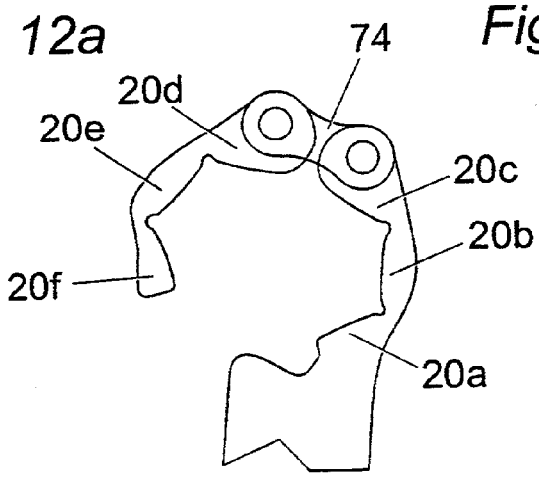
Figure 12D:
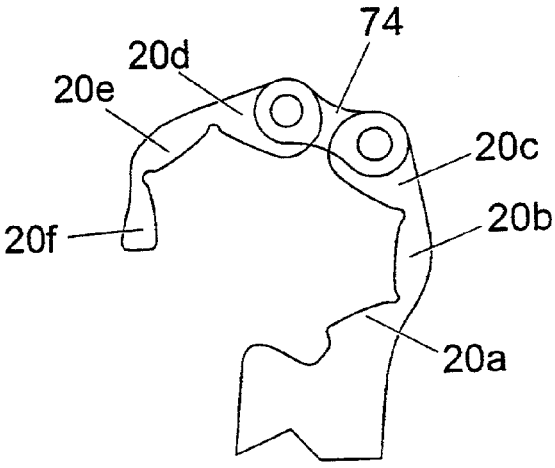
Figure 12E:
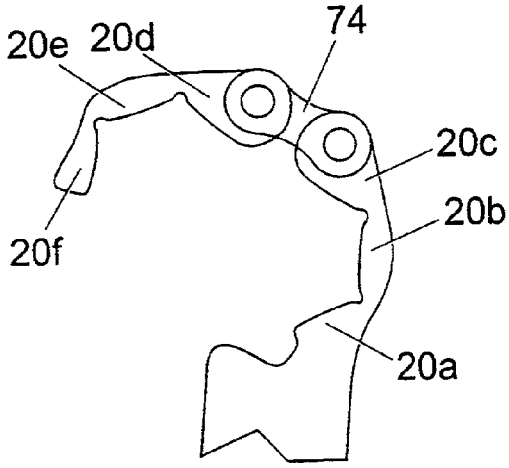
Figures 12F, 12G, 12H:
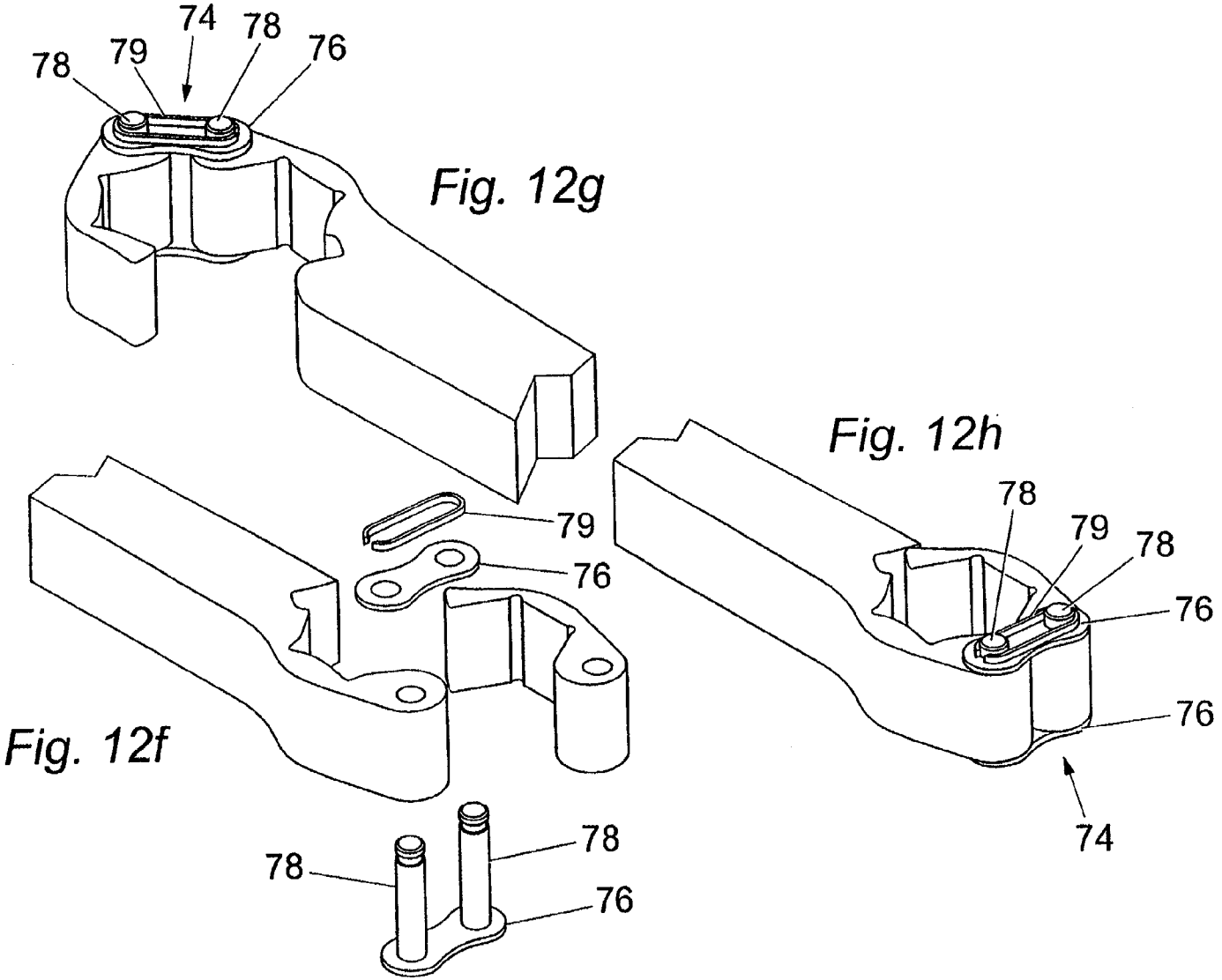

FIGS. 12*a*–12*e* are front elevations of the head portion of tenth embodiment of a wrench in accordance with the present invention, in which the head is hinged by means of a chain link interconnecting two portions of the head, FIG. 12*a* showing the head in its working position and FIGS. 12*b*–12*e* showing the head rotated by different angles about the hinge, and FIGS. 12*f*–12*h* are perspective views illustrating the chain link of FIGS. 12*a*–12*e;*

Figure 13B:
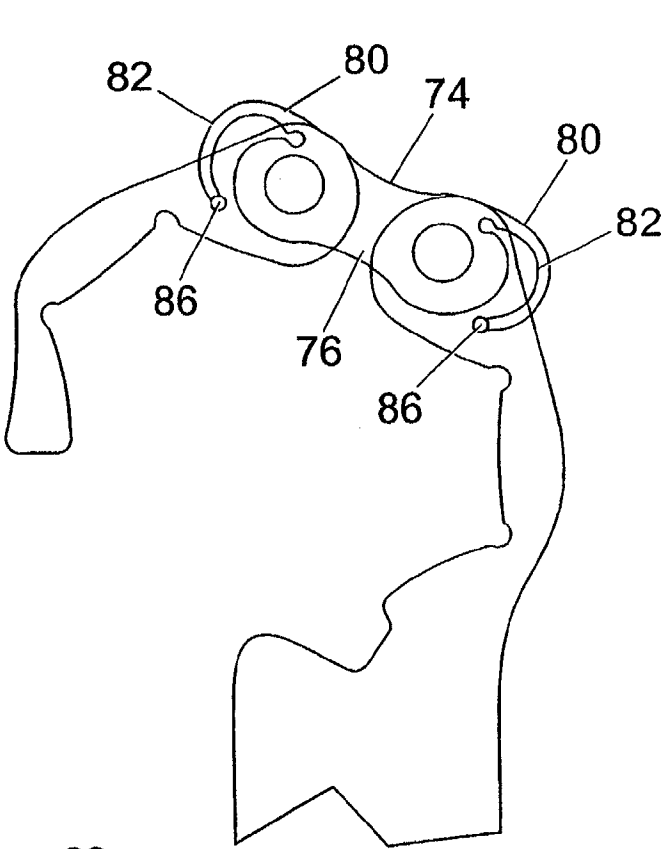
Figure 13A:
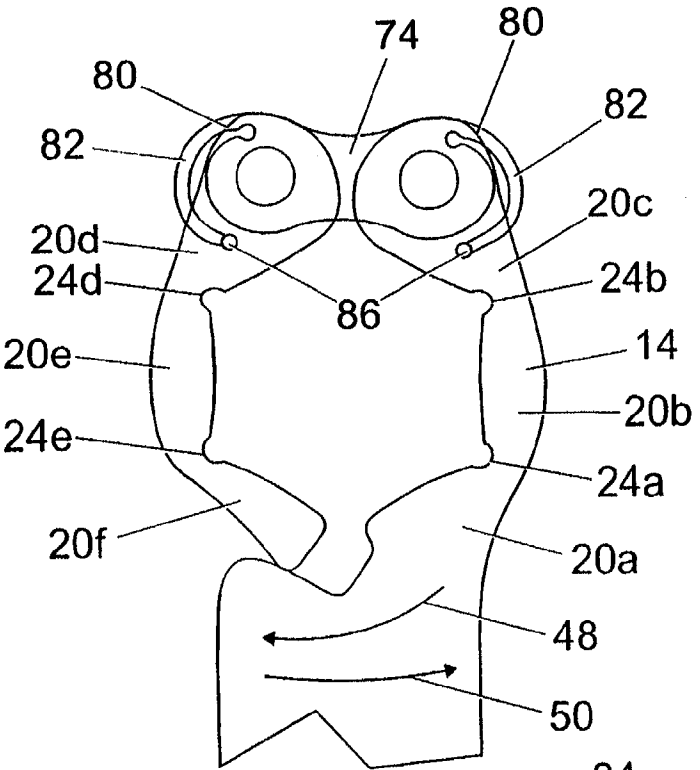
Figure 13C:
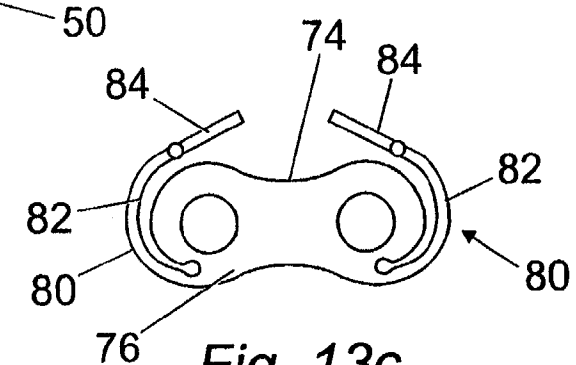
Figure 14:
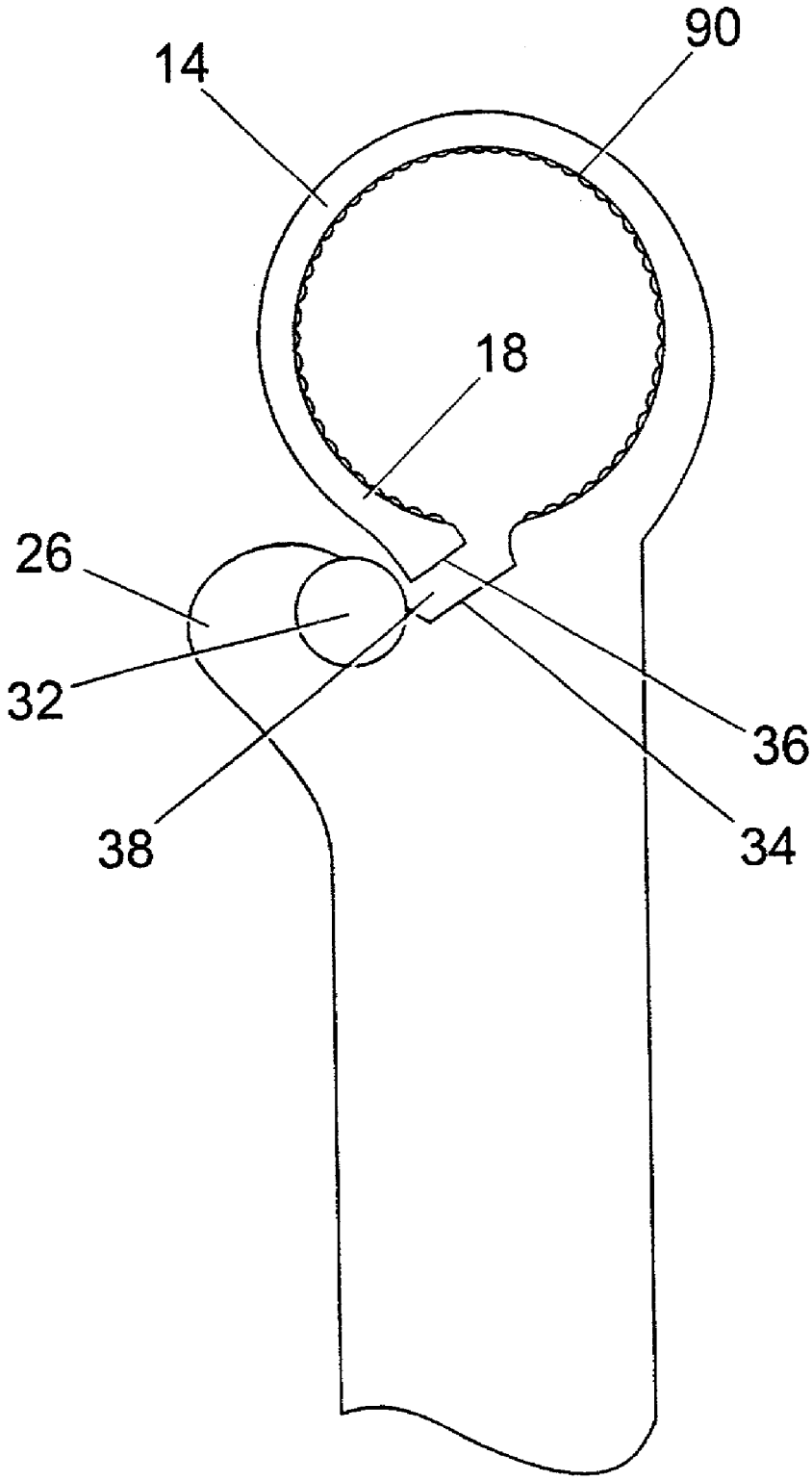
Figure 15A:
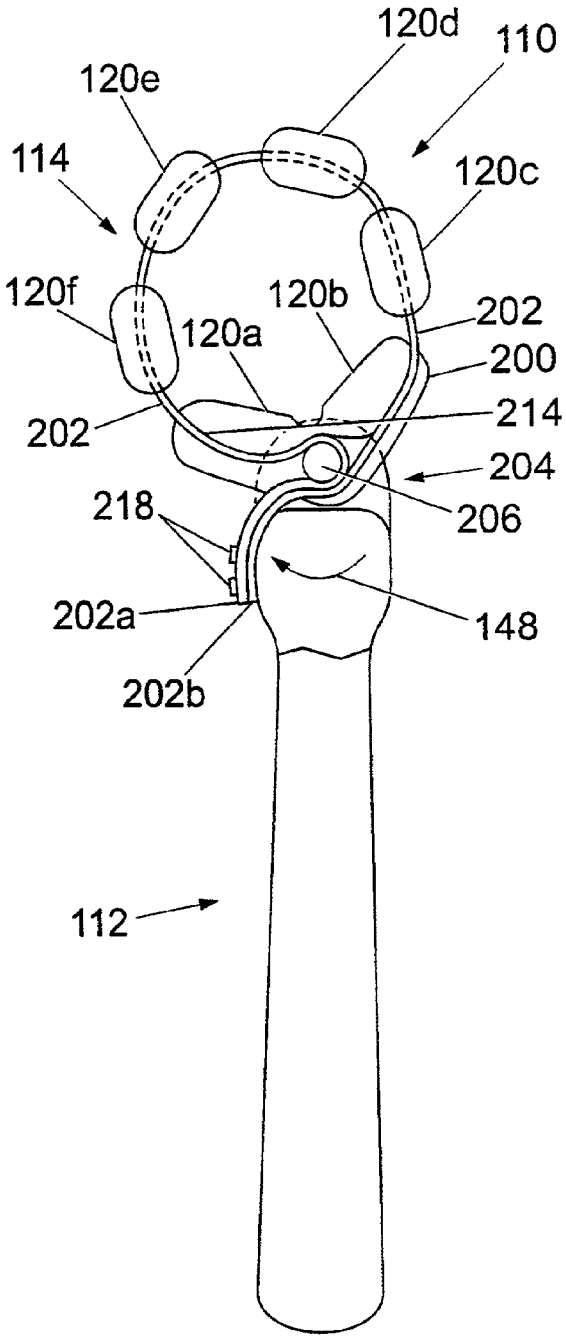
Figure 15B:
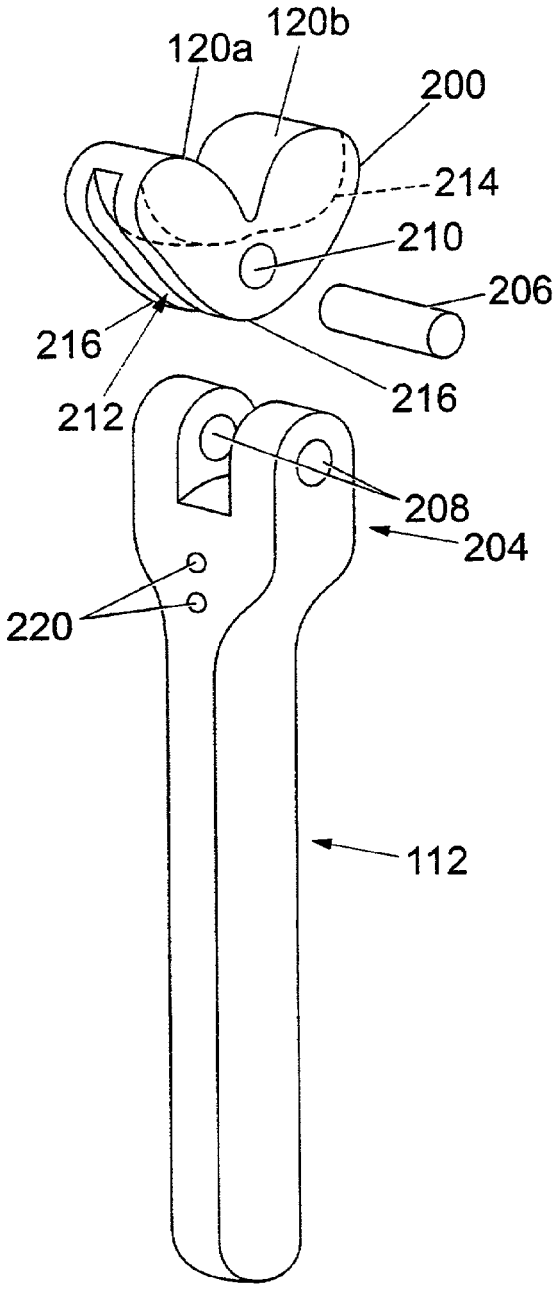

FIGS. 13*a* and 13*b* are front elevations of the head portion of an eleventh embodiment of a wrench in accordance with the invention, in which the head is hinged by means of a chain link and incorporating resilient bias means, and FIG. 13*c* is a front elevation of a chain link incorporating integral resilient bias elements;

FIG. 14 is a front elevation of the head portion of a twelfth embodiment of a wrench in accordance with the present invention; and FIG. 15*a* is a side elevation, partly in section, of a thirteenth embodiment of the present invention and FIG. 15*b* is an exploded perspective view of components of the wrench of FIG. 15*a*.

The embodiments of the invention will now be described with reference to the drawings. In the various embodiments and corresponding drawings, like reference numerals will be used to indicate like features.

Referring now to FIG. 1 of the drawings, a wrench in accordance with the invention includes a head portion 10 connected to a shaft or handle 12. The head portion 10 is in the form of a ring 14 intended to substantially surround the peripheral surface of a workpiece such as a nut, bolt or screw. In use, the inner surface of the head 10 engages the peripheral surface of the workpiece. FIG. 1 shows the wrench in its "rest" condition, with no torque applied.

The ring 14 has a first, fixed end 16 connected to the shaft 12 and a second, free end 18 which terminates close to the first end 16 but which is not connected thereto or to the shaft 12. In this embodiment, the ring 14 is divided into segments 20*a*–*f* corresponding in number to the number of faces of the peripheral surface of the workpiece with which the wrench is intended to be used, such that the inner surface of the ring 14 has a generally polygonal configuration. Preferably, the inner surface 22 of each segment 20*a*–*f* is generally convex, such that the thickness of the ring 14 varies around its circumference, being thinnest at the junctions 24*a*–*e* between adjacent segments. Preferably also, the junctions 24*a*–*e* are radiused (concave). The free end 18 comprises part of the end segment 20*f* of the ring 14.

The head 10 further includes a cam portion 26 located radially outwards from the end segment 20*f* of the ring 14 and defining a first cam surface 28 adapted to cooperate with a second cam surface 30 provided by the outer surface of the end segment 20*f* of the ring 14. The first cam surface 28 is preferably generally convex and the second cam surface 30 is preferably generally concave (such that the outer surface of the end segment 20*f* of the ring is configured as a decreasing ramp). The first cam surface 28 may be provided by an insert in the cam portion 26 such as a cylindrical pin or roller 32. Adjacent the cam portion 26 there is provided an abutment surface 34, generally parallel to an end surface 36 of the free end 18 of the ring 14 and spaced therefrom by a gap 38.

FIGS. 2*a* to 2*c* show a set of dual-head wrenches 40 incorporating the head design illustrated in FIG. 1. As in the case of conventional wrenches, wrenches in accordance with the present invention may be provided in a variety of sizes to suit standard workpiece sizes, with single or dual heads. A dual-head wrench could incorporate a first head in accordance with the invention and a second conventional head.

Figure 3B:
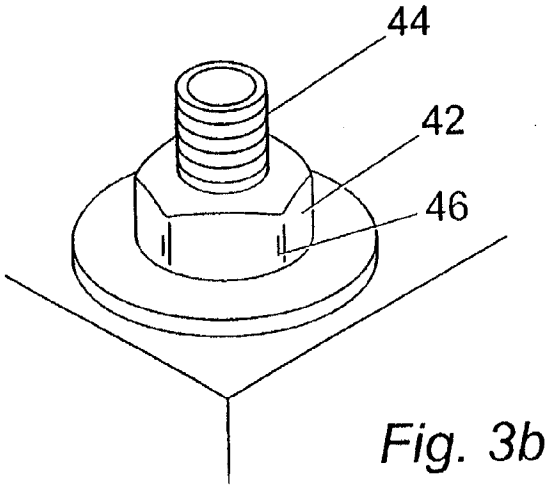
Figure 3A:
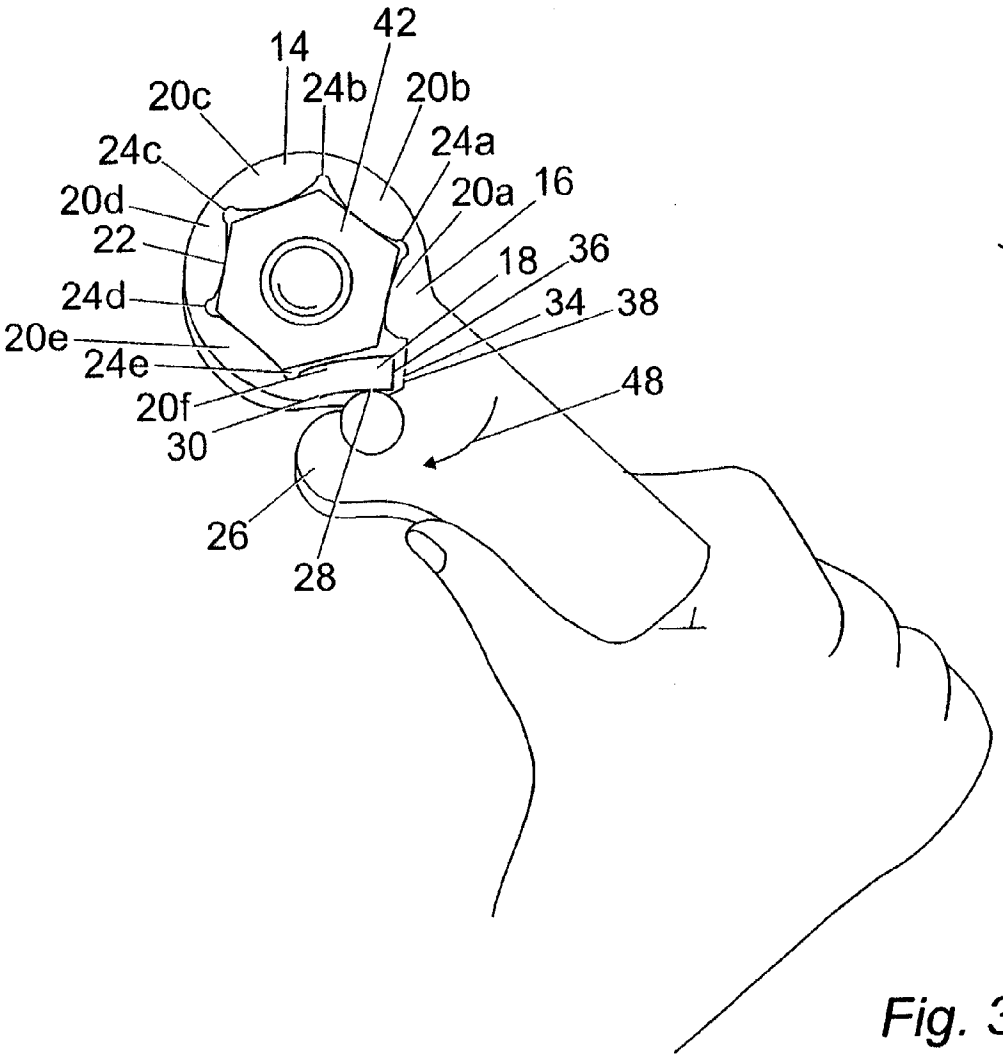

FIG. 3*b* illustrates a nut 42 engaging a bolt 44, and FIG. 3*a* shows the wrench of FIG. 1 engaging the nut 42. It is common for the nuts, bolt heads etc to become worn in use, so that the corners 46 of the nut between its peripheral faces wear flat as shown in FIG. 3*b*. The head of a conventional wrench will tend to slip around a worn nut of this type.

When a wrench in accordance with the present invention is engaged with a nut 6 as shown in FIG. 3*a* and a force applied to the head in the direction of the arrow 48 (i.e. in the direction defined by the shortest distance between the fixed end 16 and the free end 18 of the ring) then, assuming that a certain minimal degree of friction is generated between the inner surface of the ring and the nut 42, the ring 14 will deform and tend to close around the nut 42, progressively tightening the grip between the ring 14 and the nut 42 and preventing any slippage even if the nut 42 is significantly worn, damaged or undersized.

In more detail, when torque is applied to the wrench in the direction shown by the arrow 48, this causes the first cam surface 28 to press against the second cam surface 30, pushing the free end 18 of the ring 14 inwards towards the nut 42. The torque applied when the shaft is first turned causes a force to be applied radially inwards from the free end 18 onto the nut 42. This force effectively wedges the free end 18 against the nut 42. When further torque applied, the wrench shaft and ring are pulled around in the direction 48 such that the cam moves along the second cam surface 30 in the direction shown by arrow 48. The shape of the second cam surface 30 also means that the abutting surface 36 of the end segment 20*f* of the ring 14 moves towards the abutment 34, narrowing the gap 38.

In effect, the ring is being stretched from the position of the last segment 20*f* which is secured against the nut. The force transmitted around the ring 14 also acts to deform the ring at the segment junctions 24*a–e*. The convex shape of inner surfaces 22 of the ring segments 20*a–f* also serve to enhance the grip between the ring 14 and the peripheral surfaces of the workpiece. Even if the workpiece is damaged, worn or undersized, providing there is sufficient initial contact and friction between the ring and the workpiece, the ring 14 will deform inwards to provide increased grip enabling further torque to be applied to rotate the workpiece.

In the embodiments of FIGS. 1 to 3, the junctions 24*a–e* between adjacent segments 20*a–f* of the ring 14 provide "integral hinges", allowing the ring to deform elastically and close around the workpiece. The surfaces 34 and 36 limit the deformation of the ring 14 when torque is applied in the direction of the arrow 48. However, if torque was applied in the opposite direction (arrow 50 in FIG. 1), there is a risk that the ring 14 would be damaged by being deformed plastically.

Figure 4A:
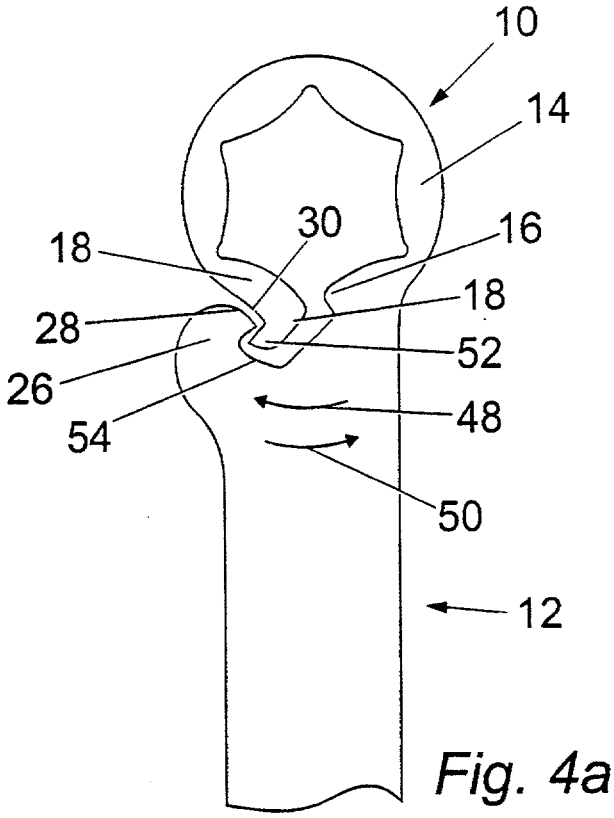
Figure 4B:
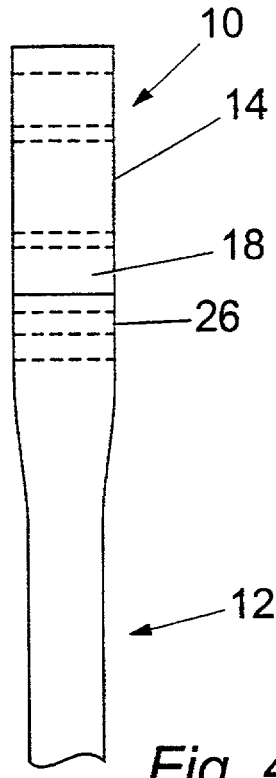

FIGS. 4*a* and 4*b* illustrate a further embodiment of the invention which is similar to that of FIG. 1 except that the head 10 includes means for preventing the ring 14 from opening excessively if the head 10 is rotated in the direction indicated by the arrow 50. The free end 18 of the ring 14 is provided with an outward projection 52 which co-operates with a corresponding recess 54 formed in the cam portion 26. In this example, the insert 32 of FIG. 1 is omitted and the first cam surface 28 is formed integrally with the cam portion 26.

Figure 5:
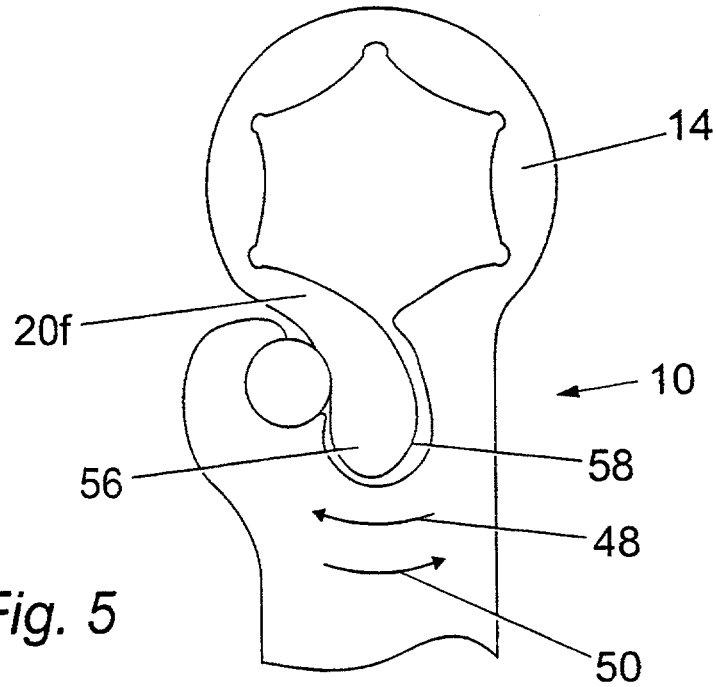

FIG. 5. illustrates a further embodiment similar to FIG. 1 and FIG. 2, with a different configuration of a catch arrangement to prevent opening of the ring. In this example, the free end 56 of the end segment 20*f* of the ring 14 is extended and is accommodated by a notch or channel 58 formed in the head portion 10 adjacent the cam portion 26. The extended free end 56 and notch 58 co-operate to limit movement of the end segment 20*f* of the ring 14 both in the direction of the arrow 48 and in the direction of the arrow 50. Other equivalent arrangements may be employed in these or any of the other embodiments of the invention to limit movement of the end segment 20*f* in either or both of the directions 48 and 50.

The embodiment of FIG. 5 again includes an insert 32 which provides the first cam surface 28 of the wrench. It will be understood that an insert of this type may be included in any of the embodiments of the invention, or the first cam surface 28 may be formed as an integral part of the head of the wrench in any of the embodiments of the invention.

In the embodiments described thus far, the head of the wrench comprises a substantially closed ring which, in use, substantially surrounds the workpiece. As with conventional ring-type wrenches, this arrangement means that, in certain circumstances, it may be difficult or impossible for the wrench to engage a particular workpiece.

FIGS. 6*a–*6*d* illustrate a further embodiment of the present invention in which the ring defined by the head of the wrench is provided with a hinge or pivot 60, enabling the ring 14 to be opened in order to engage a workpiece. In this example, the hinge 60 is provided at the junction 24*a* between first and second segments adjacent the fixed end 16 of the ring 14. FIG. 6*a* shows the ring closed, in position for use. FIGS. 6*b*, 6*c* and 6*d* illustrate the use of the hinge 60 to open the ring 14. This embodiment is particularly useful where the ring 14 of the wrench is to be fitted around, for example, a nut located on a length of pipe. The hinge 60 allows the ring 14 to be opened out to allow it to be easily fitted around the workpiece. This has particular advantages over traditional closed ring wrenches which cannot be used if the ring cannot be fitted over the end of the pipe to be positioned on the nut. Once in position, the wrench of the present invention can be used to tighten or loosen the nut or bolt as previously described.

Figure 7:
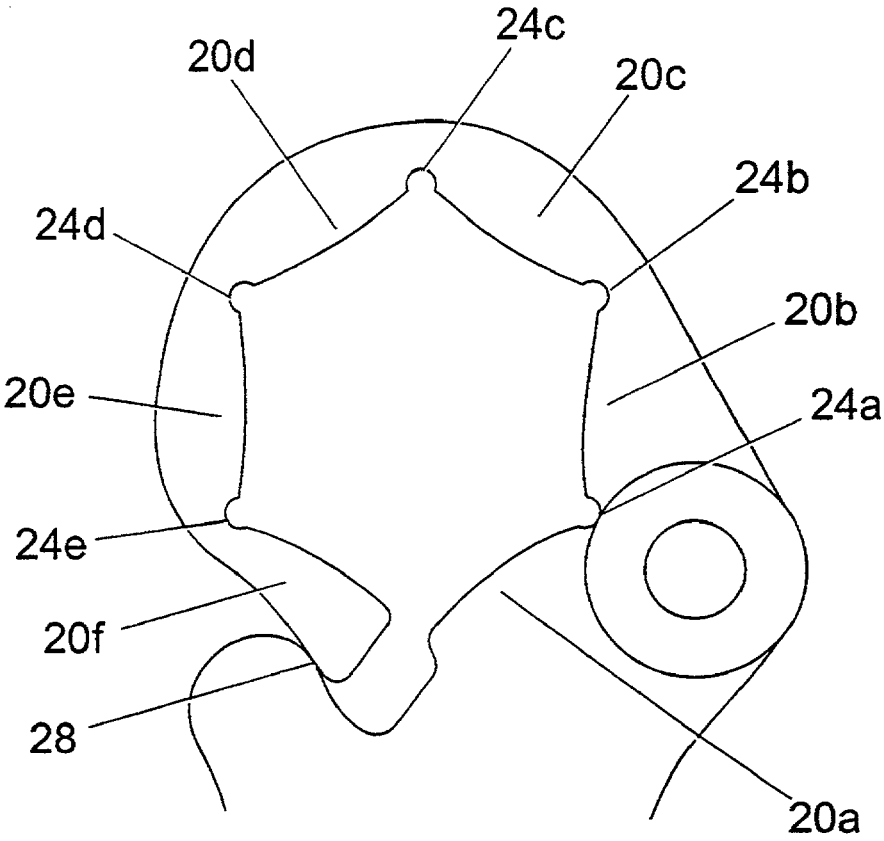
FIG. 7 is a front elevation of the head portion of a fifth embodiment of a wrench in accordance with the present invention in which the head is hinged.

FIG. 7 shows a wrench in accordance with the present invention similar to that of FIGS. 6*a–d*, but with an integral first cam surface 28 rather than an insert. In this example also, the convex inner surfaces 22 of the ring segments 20*a–f* have less curvature than in the embodiment of FIG. 1. This provides a larger surface area of contact between these surfaces and the surfaces of the workpiece. In addition, the junctions 24*a–e* are radiused so as to be substantially semicircular in profile.

Figure 8:
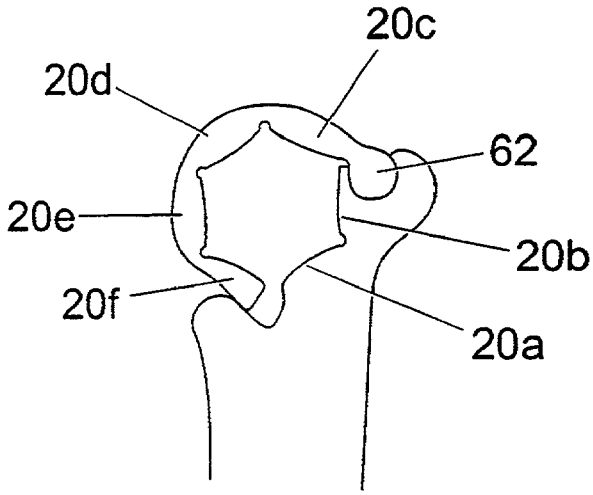
FIG. 8 is a front elevation of the head portion of a sixth embodiment of a wrench in accordance with the present invention in which the head is hinged, and in which the hinge is provided by a ball and socket joint.
Figure 9:
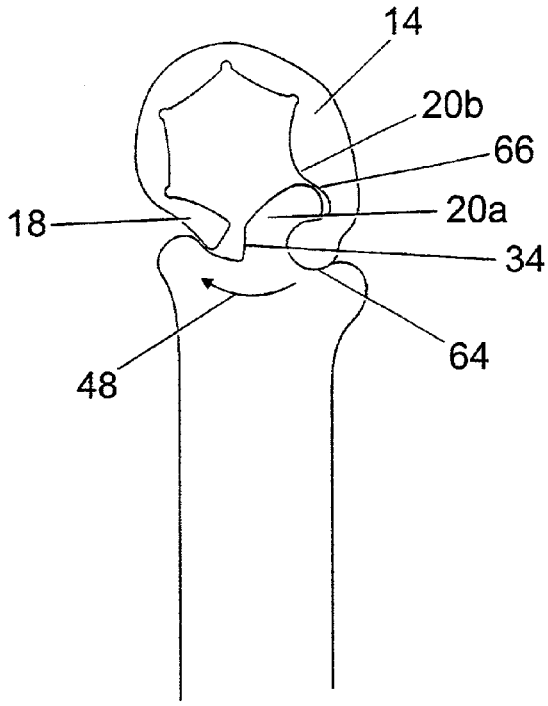
FIG. 9 is a front elevation of the head portion of a seventh embodiment of a wrench in accordance with the present invention in which the head is hinged, and in which the hinge is provided by a knuckle joint.

FIG. 8 shows further embodiment of a wrench in accordance with present invention, similar to that of FIGS. 6*a–d*, but with a hinge provided by ball and socket joint 62 which, in this example, is located between the second and third ring segments 20*b*,20*c*. FIG. 9 shows a wrench in accordance with the present invention similar to that of FIGS. 6*a–d*, with a knuckle joint 64 providing a hinge between the first and second ring segments 20*a*,20*b*. This embodiment is shown in its working position, where a torque is to be applied in the direction shown by arrow 48, such that the free end 18 of the ring 14 moves freely towards the abutment 34. The extent of this free movement is determined by a gap 66 formed by the knuckle joint between the adjacent ring segments 20*a*,20*b*. Once this gap 66 has been closed, any additional torque will cause the ring 14 to deform and the area inside the ring to decrease. The abutment of the segments 20*a*,20*b* provides additional leverage.

FIGS. 10*a*, 10*b* and 10*c* show a wrench in accordance with the present invention similar to that of FIGS. 6*a–d*, with an extended ball and socket joint 68 providing a hinge between the second and third ring segments 20*b*,20*c*. This figure also shows the extent to which the ring 14 may be opened to allow an object to be fitted inside the ring. As with FIG. 9, the ring 14 moves freely until an extension portion 71 of the ball and socket joint 68, connected to the third ring segment 20*c*, abuts against the outer surface of the second ring segment 20*b*. Thereafter, the area inside the ring is decreased by deformation of the ring about the junctions 24*c–e* between the segments 20*c–f*.

FIGS. 11*a*, 11*b* and 11*c* illustrate a further embodiment of the present invention in which pivot hinges 72 are provided between each of the segments 20*a–f* of the ring 14.

In use, the wrench illustrated in FIGS. 11*a*, 11*b* and 11*c* allows the ring 14 to be opened out as shown in FIG. 11*b* because each of the segments is rotatable about the hinges 72. This again allows the wrench to be positioned around a nut or bolt located on a length of pipe.

Whilst the above examples describe a ring inner surface which is substantially hexagonal in shape, in its working position, further examples of the present invention are envisaged in which the inner surface is triangular, square, pentagonal, heptagonal, octagonal, nonagonal, decagonal or having a larger number of sides.

FIGS. 12*a–e* illustrate a further embodiment of the present invention in which the third and fourth ring segments 20*c*,20*d* are hingeably connected by a chain link 74.

The term "chain link" as used herein means an arrangement in which a plate member 76 having a figure-of-eight configuration is disposed on either side of the ring 14 and pivot pins 78 extend between the plates 76 through bores formed at the ends of the adjacent ring segments 20*c*,20*d*. This is a preferred form of hinge for use in accordance with the present invention and may be employed to interconnect one or more pairs of ring segments other than or in addition to the third and fourth segments as shown in this embodiment. FIG. 12*a* shows the wrench in its working position (closed) and FIGS. 12*b–e* show the ring 14 progressively opening from the working position. FIGS. 12*f* to 12*h* illustrate the chain link 74 in more detail. FIG. 12*f* is an exploded view of the chain link 74, also including a spring clip 79 which would normally be included in a chain link of this type. FIG. 12*g* shows the ring 14 hinged open and FIG. 12*h* shows the ring 14 hinged closed.

FIGS. 13*a* and 13*b* show a further embodiment of the invention, similar to that of FIGS. 12*a–e*, in which the chain link hinge 74 is provided with resilient bias means comprising spring elements 80 which tend to urge the ring 14 towards its normal closed, working position, illustrated in FIG. 13*a*. The combination of the hinge and resilient bias means generally provides a junction between the adjacent ring sections connected by the hinge 74 (segments 20*c*,20*d* in this preferred example) which is more flexible than the "integral hinges" provided by the junctions 24*a,b,d,e* between the other pairs of adjacent segments. The use of such resilient bias means that the wrench operates in a substantially identical manner to that of the embodiment of FIG. 1 when rotated in the direction 48. However, when rotated in the opposite direction 50, the resilient bias means associated with the hinge 74 allows the ring 14 to open slightly so that the ring 14 may rotate relative to the workpiece, thereby providing a type of ratchet mechanism so that the wrench does not need to be removed from the workpiece between successive strokes in the "working direction" 48. The bias means allows the ring to rotate relative to the workpiece on the return stroke, and urges the ring segments back into their working position for the next working stroke.

In this example, the spring elements 80 are formed integrally with the plates 76 of the chain link 74, comprising resilient arms 82 which extend from either end of the plates 76, curving in the plane of the plates 76 around the outer ends thereof, and having end portions 84 which are bent out of the plane of the plates 76. When the plates 76 are located on either side of the ring segments 20*c*,20*d*, the end portions 84 of the arms 82 project into and engage with apertures 86 formed in the side faces of the adjacent ring segments 20*c*,20*d*.

The ring 14 may be opened against the return force of the spring elements 80 as seen in FIG. 13*b*, allowing the wrench to engage, for example, a nut located on a length of pipe, as in the previous embodiments of the invention incorporating hinged rings.

It will be understood that different types of resilient bias means may be incorporated into chain link hinges of the type employed in the embodiments of FIGS. 12 and 13, or into other types of hinges.

FIG. 14 shows a further embodiment of the present invention in which the inside surface of the ring 14 is substantially circular, rather than polygonal. The inner surface of the ring 14 is provided with corrugations or serrations 90 which grip the workpiece inside the ring on application of a torque. The ring 14 as a whole is sufficiently flexible to deform and close around the workpiece. The size, shape and distribution of the corrugations 90 will depend on the nature of the intended workpiece. This embodiment may also be modified to incorporate variations of the cam surfaces, stops and catches, hinges etc. described in relation to previous embodiments. Also, the segmented rings of previous embodiments may be provided with serrations or corrugations on their inner surfaces.

FIGS. 15*a* and 15*b* show a further alternative embodiment of a wrench in accordance with the present invention, again comprising a assembly 110 and a shaft 112.

In this embodiment, the head 110 comprises a ring assembly 114 which consists of a generally V-shaped member 200, the inner surfaces which define first and second segments 120*a* and 120*b* of the ring, and a plurality of discrete segments 120*c–f*. The V-shaped member 200 and the segments 120*c–f* are interconnected by an elongate, substantially inelastic, flexible member 202, such as a strap or the like (suitably formed from metal, plastics, leather or textile material) which is threaded through the segments 120*c*–f. The head 110 further includes a yoke portion 204 formed at the upper end of the shaft 112. The V-shaped member is pivotably mounted in the yoke portion 204 by means of a pivot pin 206 which extends through yoke apertures 208 and complementary apertures 210 formed adjacent the apex of the V-shaped member 200.

The outer surface of the V-shaped member 200 is formed with a channel 212, defining a saddle surface 214 extending between two lug portions 216 which contain the apertures 210. The strap 202 has first and second free ends 202*a* and 202*b*. The first free end 202*a* of the strap 202 extends from the segment 120*f*, passes around one half of the saddle surface 214 opposite the segment surface 120*a*, over the top of, around and under the pivot pin 206, and out of the front of the yoke portion 204. The second free end 202*b* of the of the strap 202 extends from the segment 120*c*, passes around the second half of the saddle surface 214 opposite the segment surface 120*b*, under the first free end 202*a* and the pivot pin 206, and out of the front of the yoke portion 204. Both of the free ends 202*a* and 202*b* are secured to the front of the yoke portion 204 by any suitable means such as rivets 218 engaging apertures 220.

In use, the ring assembly 114 is placed over the workpiece. When torque is applied to the yoke 204 in the direction of the arrow 148, the yoke 204 pivots relative to the V-shaped member 200, pulling on the second free end 202*b* of the strap 202 so that the trap 202 is pulled through the segments 120*c–f*, closing the ring 114 about the workpiece by decreasing the circumference of the head ring 114 and tightening the grip of the ring 114 around the workpiece. Further torque applied to the shaft allows the workpiece to be rotated with the head of the wrench.

It will be appreciated that the extent of tightening of the strap per unit angle through which the shaft has been turned in the direction of arrow 148 is dependent upon the circumference of the pivot pin 206. A larger pin circumference will tighten the strap by turning the shaft through a smaller angle than would be required where the pin circumference is smaller.

If torque is applied opposite to the direction of the arrow 148, the angle between the head and the shaft is changed such that the strap is loosened to allow the head 122 to be fitted over larger workpieces. The wrench 100 is operated as before, by turning the shaft in the direction of arrow 124. This embodiment therefore provides additional flexibility by allowing the wrench to be used on differently sized work pieces depending on the initial angle between the shaft and the head. The arrangement may also allow the ring 114 to ratchet about the workpiece on return strokes between working strokes, as previously described in relation to other embodiments of the invention.

Improvements and modifications may be incorporated without departing from the scope of the invention as defined in the claims appended hereto.

What is claimed is:

1. A wrench having a head portion adapted to engage and apply torque to a workpiece, and turning means for turning said head portion, the wrench further comprising:

a flexible ring portion included in said head portion and attached to said turning means at one end and free at its other end, said ring portion having an inner working surface for engaging the workpiece;

clamping means included in the turning means for clamping the free end of the ring portion against the workpiece when the turning means is turned in a predetermined direction;

a portion of the flexible ring portion at or adjacent the free end thereof having an external, first cam surface which defines a wedge shape with the inner working surface of said portion;

said wedge shape increasing in thickness towards the free end of the flexible ring portion; and said clamping means having a second cam surface arranged to cooperate with said wedge-shaped portion so that when torque is applied to said head portion in said predetermined direction, said wedge-shaped portion is urged in such a peripheral direction relative to the workpiece as to tend to close the flexible ring portion around said workpiece.

2. A wrench as claimed in claim 1, wherein said ring portion is pivotably connected to a yoke portion of said head and comprises a plurality of segments interconnected by an elongate flexible member having first and second free ends secured to said yoke portion such that pivoting movement of said ring relative to said yoke in a predetermined direction causes a length of said elongate flexible member passing around said ring to be shortened and the ring to close.

3. A wrench as claimed in claim 2, wherein first and second segments of said ring are formed integrally with one another as part of a pivot member pivotably mounted in said yoke portion by means of a pivot pin and the remainder of said segments are formed as discrete members, said flexible elongate member being threaded through said remainder of said segments having free ends thereof passing around an outer surface of said pivot member and around said pivot pin.

4. A wrench as claimed in claim 3, wherein the first free end of the flexible elongate member extends from one of said discrete segments, passes around one part of said outer surface of said pivot member opposite an inner surface thereof defining a first segment, over the top of, around and under the pivot pin, and out of the front of the yoke portion, and wherein the second free end of the elongate flexible member extends from another of said discrete segments, passes around a second part of said outer surface of the pivot member opposite an inner surface thereof defining a second segment, under the first free end and the pivot pin, and out of the front of the yoke portion.

5. A wrench as claimed in claim 1, wherein said second cam surface is generally convex.

6. A wrench as claimed in claim 1, wherein said first cam surface is generally concave.

7. A wrench as claimed in claim 1, wherein said second cam surface is formed integrally with said wrench.

8. A wrench as claimed in claim 1, wherein said second cam surface is provided by an insert.

9. A wrench as claimed in claim 1, wherein said flexible ring portion comprises a plurality of segments.

10. A wrench as claimed in claim 9, wherein said segments define a generally polygonal inner surface of said flexible ring portion.

11. A wrench as claimed in claim 9, wherein each of said segments has an inner surface which is generally convex.

12. A wrench as claimed in 9, wherein at least some of said segments are formed integrally with one another and said flexible ring portion is adapted to deform resiliently at junctions between adjacent, integrally formed segments.

13. A wrench as claimed in claim 12, wherein said junctions between adjacent, integrally formed segments have a reduced thickness from the remainder of said segments.

14. A wrench as claimed in claim 13, wherein said junctions comprise portions of the inner surface of said flexible ring portion which are generally concave in the circumferential direction of said flexible ring portion.

15. A wrench as claimed in claim 1, wherein the inner surface of said flexible ring portion is corrugated.

16. A wrench as claimed in claim 1, wherein said head portion includes means for limiting movement of said portion of said flexible ring portion relative to said fixed end thereof in said predetermined direction.

17. A wrench as claimed in claim 1, wherein said head portion includes means for limiting movement of said portion of said flexible ring portion relative to said fixed end thereof in a direction opposite to said predetermined direction.

18. A wrench as claimed in claim 1, wherein said head portion includes hinge means whereby at least a portion of said flexible ring portion may be pivoted in the plane of said ring member relative to the remainder of said head portion.

19. A wrench as claimed in claim 18, wherein said flexible ring portion comprises a plurality of segments and wherein said hinge means is located between at least one pair of adjacent segments.

20. A wrench as claimed in claim 18, including resilient bias means associated with said hinge means and adapted to bias said flexible ring portion towards a closed position.

* * * * *